United States Patent [19]

Sendov et al.

[11] 4,097,927

[45] Jun. 27, 1978

[54] APPARATUS FOR MIXING BULK MATERIALS

[75] Inventors: Stoyan Hristov Sendov, Sofia; Ivan Alexandrov Kuklin, Vidin; Ivan Angelov Nikolov, Vidin; Assen Ninov Ivanov, Vidin; Mircho Georgiev Mirchev, Vidin; Radoslav Borissov Kurtashev, Vidin, all of Bulgaria

[73] Assignee: Chimkombinat, Vidin, Bulgaria

[21] Appl. No.: 708,688

[22] Filed: Jul. 26, 1976

[30] Foreign Application Priority Data

Aug. 2, 1975 Bulgaria ..... 30712

[51] Int. Cl.[2] ..... B01F 5/26; B01F 7/16

[52] U.S. Cl. ..... 366/247; 366/280

[58] Field of Search ..... 259/95, 96, 4 R, 8, 259/18, 36

[56] References Cited

U.S. PATENT DOCUMENTS

| | | | |
|---|---|---|---|
| 3,164,376 | 1/1965 | Clark | 259/4 R |
| 3,744,765 | 7/1973 | Bard | 259/96 |
| 3,756,569 | 9/1973 | Wohlfarth | 259/95 |
| 3,807,705 | 4/1974 | Humkey | 259/95 |

*Primary Examiner*—Billy S. Taylor
*Attorney, Agent, or Firm*—Karl F. Ross

[57] ABSTRACT

An apparatus for mixing bulk materials, comprising a vertical cylinder and an inclined bottom, wherein in the axis of the vertical cylinder there is provided an internal pipe, and outside of it there is fastened an outer pipe, and both pipes are connected in their bottom end to a centrifugal ventilator, and above the internal pipe there is arranged a mixer.

2 Claims, 1 Drawing Figure

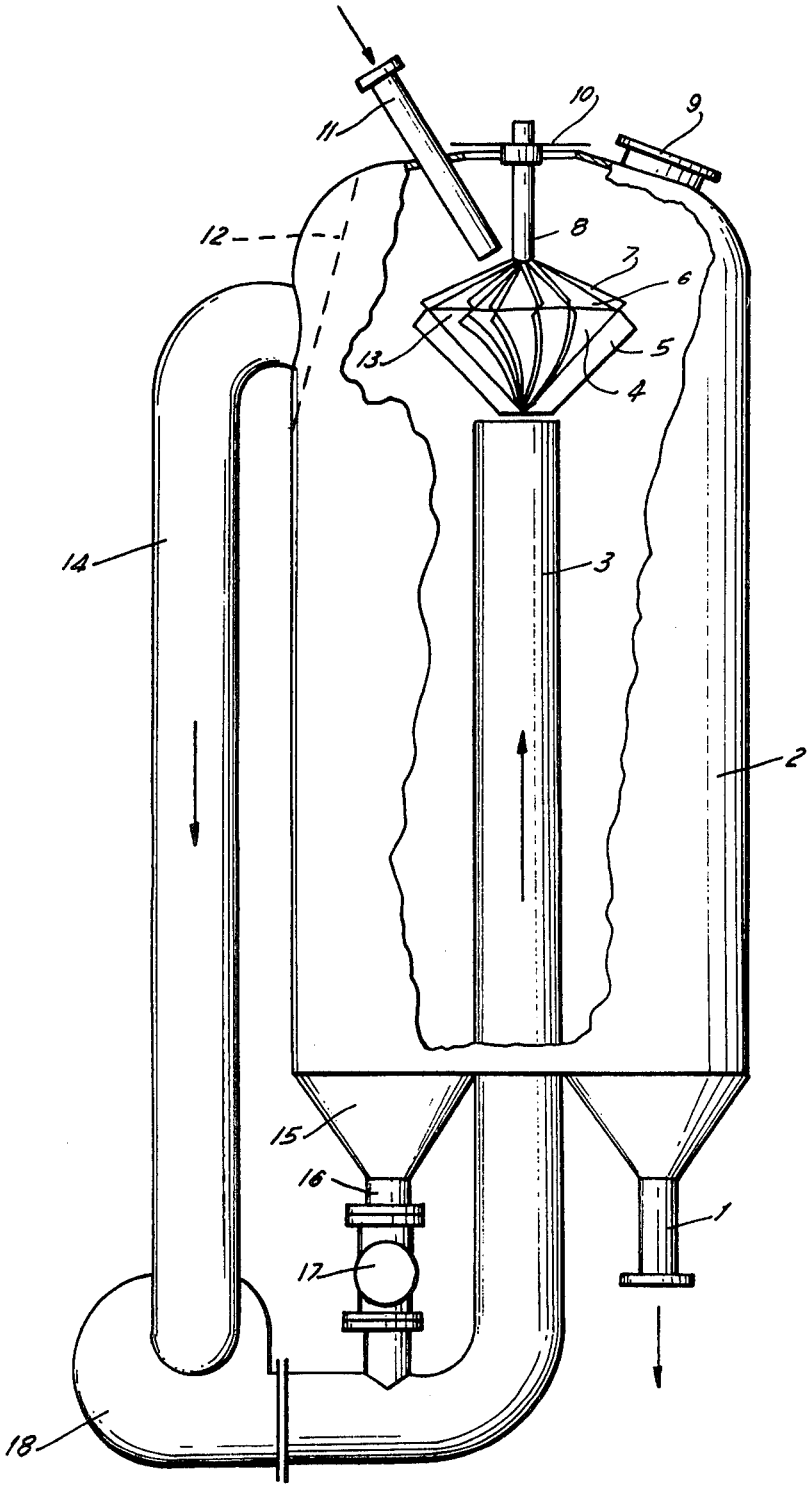
10
9
11
12
8
7
6
13
5
4
14
3
2
15
16
1
17
18

APPARATUS FOR MIXING BULK MATERIALS

This invention relates to an apparatus for mixing bulk materials, such as granulated polyamide and other granular materials, which can be used in the chemical and food industries.

Apparatus for mixing bulk materials is known, and can comprise a vertical screw or outer elevator (fed by a horizontal screw), arranged under devices for displacing and mixing the material. In several cases in the upper part of the apparatus there is provided a second horizontal screw for mixing the fresh incoming material with the material introduced by the elevator.

It is a drawback of an apparatus of such design that it has a large number of movable parts which can be damaged, giving rise to the stopping of work during repair.

It is an object of the invention to avoid the drawbacks of known apparatus for mixing bulk materials by providing an apparatus for mixing bulk materials which is of simple design and operable to achieve a high degree of mixing.

This object is achieved by providing the apparatus, which comprises a vertical cylinder and an inclined bottom, along its axis with an internal pipe, and on its outer side there is fastened a vertical pipe, these pipes being connected at their bottom ends to a centrifugal ventilator (blower), while at the upper end of the internal pipe there is disposed a mixer. This mixer comprises two oppositely converging cones, connected at their bases and provided with blades at their outer surface. The mixer (rotor) is attached to rotate freely about an axis, which is fastened to the cover of the apparatus.

The advantageous features of the apparatus of the invention are its simple design, its reliability in operation and the high degree of mixing. Furthermore, it can be used for cooling the material and dust removal.

For a better understanding of the invention, reference should be made to the accompanying drawing, the sole FIGURE of which illustrates a preferred embodiment of the invention in a vertical elevational view, partly broken away of an apparatus in accordance with the present invention.

The apparatus for mixing bulk materials comprises a vertical cylinder 2 with bottom 15, which is suitably inclined in order to avoid any stagnant zones, to which there a fastened pipe connections 1 and 16. To pipe connection 16 there is fastened a pneumatic shut-off valve 17.

Along the axis of vertical cylinder 2 there is disposed an internal pipe 3, above which, in the cover 10 of the apparatus, there is fixed a mixer 13. This mixer comprises a long cone 4 and an upper cone 6, which are connected at their bases. To the bottom cone 4 there are fastened bow-shaped curved blades 5 while the upper cone is formed with radial blades 7. The mixer is attached freely to the shaft 8, which is fastened to the cover 10.

To the upper part of the vertical cylinder 2 there is connected an outer pipe 14. At the inlet of this pipe in the vertical cylinder 2 there is provided a sieve 12. The bottom end of the outer pipe 14 is connected to the suction flange (intake side) of ventilator or blower 18. The outlet flange of this ventilator (discharge side) is connected to the internal pipe 3. On top of vertical cylinder 2 there are provided an access hatch 9 and a pipe 11 for fresh incoming material.

The apparatus of the present invention operates as follows:

Ventilator 18 is switched on, which sucks gas from the vertical cylinder 2 through pipe 14. Sieve 12 prevents entry of particles of the material into pipe 14 and ventilator 18. The gas entrains the solids entering through pipe connection 16 and valve 17, and returns it back through the internal pipe 3 into vertical cylinder 2.

The flow coming out of the internal pipe 3 imparts a rotational motion to mixer 13 due to the bow-shaped curved blades 5, fastened to bottom cone 4. The rotation of radial blades 7 of the upper cone 6 causes the uniform spraying of the fresh material entering through pipe 11 which is trained on the mixer 13 and its mixing with the material recirculating through the internal pipe 3. The mixed material is discharged through pipe connection 1.

What we claim is:

1. An apparatus for mixing bulk material, comprising: a vertically elongated upright cylinder formed with a sloping bottom;

an internal pipe extending upwardly in said cylinder along the axis thereof and opening at a free end below the top of said cylinder into the interior thereof;

a centrifugal blower having a discharge side connected to said pipe;

an intake duct connected to the intake side of said blower and disposed externally of said cylinder, said intake duct communicating with the interior of said cylinder above said free end of said pipe;

a rotatable vaned mixing rotor freely rotatable in said cylinder and disposed above said free end for propulsion by fluid emerging therefrom; and an inlet pipe for delivering material to be mixed with the bulk material in said container and depositing same upon said rotor, said rotor comprising a lower cone and an upper cone, said cones being connected at their bases, said lower cone being formed with bow-shaped curved blades and said upper cones being formed with radial blades.

2. The apparatus defined in claim 1, further comprising a duct communicating between the bottom of said cylinder and said internal pipe for circulating bulk material from the interior of said cylinder into said internal pipe.

* * * * *